US010599085B2

(12) United States Patent
Shimoi

(10) Patent No.: US 10,599,085 B2
(45) Date of Patent: Mar. 24, 2020

(54) IMAGE FORMING APPARATUS HAVING CONTROL RELATIVE TO COLLECTED TONER AMOUNT

(71) Applicant: CANON KABUSHIKI KAISHA, Tokyo (JP)

(72) Inventor: Yasuhiro Shimoi, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/228,828

(22) Filed: Dec. 21, 2018

(65) Prior Publication Data

US 2019/0196383 A1 Jun. 27, 2019

(30) Foreign Application Priority Data

Dec. 26, 2017 (JP) ..... 2017-250194

(51) Int. Cl.
*G03G 15/00* (2006.01)
*G03G 21/10* (2006.01)
*G03G 21/12* (2006.01)

(52) U.S. Cl.
CPC ..... *G03G 15/55* (2013.01); *G03G 15/556* (2013.01); *G03G 21/105* (2013.01); *G03G 21/12* (2013.01)

(58) Field of Classification Search
USPC ..... 399/35
See application file for complete search history.

(56) References Cited

U.S. PATENT DOCUMENTS 7,894,730 B2 2/2011 Okano et al.
8,929,755 B2 * 1/2015 Itagaki ..... G03G 21/105 399/35
2007/0264036 A1 * 11/2007 Craig ..... G03G 21/105 399/35
2008/0159760 A1 * 7/2008 Okano ..... G03G 21/12 399/35
2010/0098442 A1 * 4/2010 Lee ..... G03G 15/553 399/35

FOREIGN PATENT DOCUMENTS

JP 2000-019923 A 1/2000
JP 2003-248402 A 9/2003
JP 2008-164918 A 7/2008
JP 2014-115354 A 6/2014

* cited by examiner

*Primary Examiner* — Quana Grainger
(74) *Attorney, Agent, or Firm* — Venable LLP

(57) ABSTRACT

An image forming apparatus is configured to output first information for urging arrangement of delivery of a container of toner based on a detection result of a toner sensor. When a first period from a detection of toner to an arrival at a first predetermined value of an accumulation value of a count portion is longer than a predetermined period, image formation is inhibited based on the accumulation value and second information for urging replacement of the container is outputted. When the first period is shorter than the predetermined period, the image formation is continued during the predetermined period until a detection result of a load sensor reaches a second predetermined value.

6 Claims, 6 Drawing Sheets

IMAGE FORMING APPARATUS HAVING CONTROL RELATIVE TO COLLECTED TONER AMOUNT

BACKGROUND OF THE INVENTION

Field of the Invention

The present invention relates to an image forming apparatus, such as a printer, a copying machine, a facsimile (fax) machine, or a multifunctional peripheral, employing an electrophotographic system, and more particularly, to an image forming apparatus including a toner container that is removably mounted to an apparatus main body.

Description of the Related Art

Hitherto, in an electrophotographic image forming apparatus, un-transferred residual toner scraped off by a cleaning unit from a photosensitive drum or an intermediate transfer belt, or developer deteriorated in a developing device is collected to be stored in a container. Such a container has a predetermined allowable amount, and when a containing amount reaches the allowable amount, the container is replaced with a new empty container. However, when the container is used even after the containing amount exceeds the allowable amount, an internal conveyance screw may receive a large resistance from the condensed toner, and thus an abnormality may occur in a drive system on an apparatus main body side. Therefore, when the containing amount of the container exceeds the allowable amount, an error is displayed and image formation is inhibited until the replacement of the container is completed.

It is not preferred to stop the image forming apparatus, and hence before the toner containing amount reaches the allowable amount and the image forming apparatus is stopped, the day on which the containing amount reaches the allowable amount is estimated with use of, for example, a sensor configured to detect the toner containing amount, and a replacement preparation notification is output to a service center several days before the estimated day. When the service center receives the replacement preparation notification, the service center delivers a new empty container to a user so that the container can be replaced immediately after the toner containing amount exceeds the allowable amount and the image forming apparatus is stopped. Further, there is known an image forming apparatus configured to change the timing to output the replacement preparation notification based on the number of times of image formation in order to cope with the number of times of image formation that differs depending on a user (see Japanese Patent Application Laid-Open No. 2014-115354). For example, for a user that frequently performs image formation, the timing to output the replacement preparation notification after the sensor detection is advanced, and for a user that infrequently performs image formation, the timing to output the replacement preparation notification after the sensor detection is delayed.

However, in the above-mentioned image forming apparatus described in Japanese Patent Application Laid-Open No. 2014-115354, when the number of times of image formation of the user abruptly increases after the replacement preparation notification is output, a collection speed exceeds a collection speed estimated based on the initial number of times of image formation, and the containing amount may exceed the allowable amount earlier than estimated. In this case, the image forming apparatus may be unusable for a long period until the empty container for replacement is delivered.

SUMMARY OF THE INVENTION

The present invention provides an image forming apparatus capable of preventing the image forming apparatus from being unusable for a long period even when an amount of toner to be collected into a container reaches a predetermined amount in a period shorter than assumed after output of a replacement preparation notification, which is output when a toner containing amount of the container is close to an allowable amount.

According to one embodiment of the present invention, there is provided an image forming apparatus, comprising:

an image forming portion configured to form an image;

a container configured to contain toner collected from the image forming portion;

a conveyance member, which is provided inside of the container so as to be rotatable, and is configured to convey the toner contained in the inside;

a toner sensor configured to detect toner presence or toner absence at a detection portion provided in the inside of the container and on downstream of the conveyance member in a conveyance direction;

a count portion configured to count a value correlated to a toner amount collected into the container;

a controller configured to output first information for urging arrangement of delivery of the container based on a detection result of the toner sensor; and a load sensor configured to detect a rotation load of the conveyance member, wherein, when a first period from when the toner sensor detects the toner presence to when an accumulation value counted by the count portion reaches a first predetermined value is longer than a predetermined period, the controller outputs second information for urging replacement of the container and inhibits image formation based on the accumulation value counted by the count portion, and wherein, when the first period is shorter than the predetermined period, the controller is allowed to continue an image forming operation during the predetermined period until a detection result of the load sensor reaches a second predetermined value.

Further features of the present invention will become apparent from the following description of exemplary embodiments with reference to the attached drawings.

DESCRIPTION OF THE EMBODIMENTS

An image forming apparatus according to an embodiment of the present invention is described with reference to FIG. 1 to FIG. 6. First, a schematic configuration of the image forming apparatus according to this embodiment is described with reference to FIG. 1, FIG. 2A, and FIG. 2B.

[Image Forming Apparatus]

Figure 1:
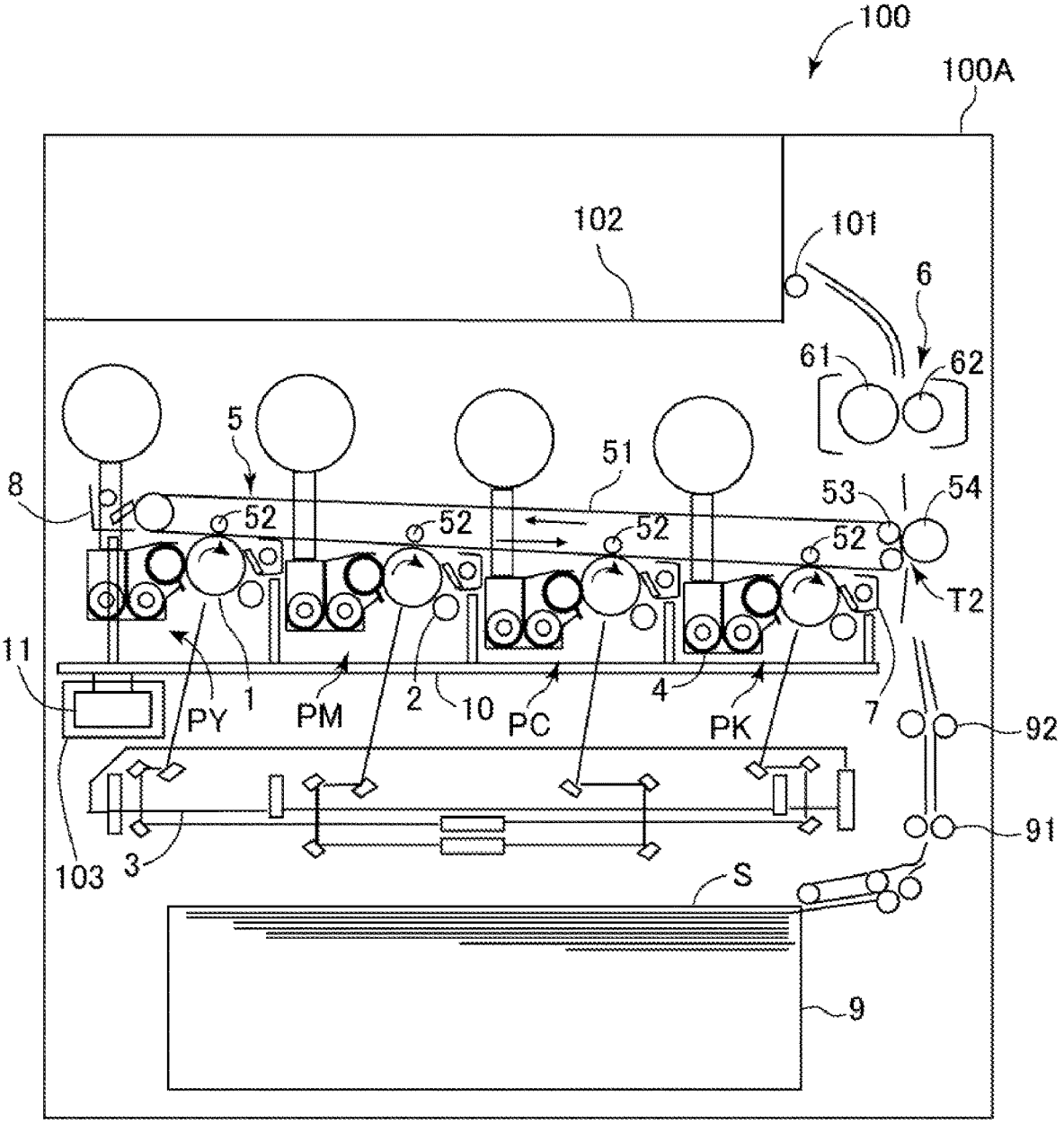
FIG. 1 is a schematic view for illustrating a configuration of an image forming apparatus according to an embodiment of the present invention.

As illustrated in FIG. 1, an image forming apparatus 100 according to this embodiment is an electrophotographic tandem-type full-color printer including four image forming portions PY, PM, PC, and PK each including a photosensitive drum 1 serving as an image bearing member. The image forming apparatus 100 forms a toner image (image) on a recording material in accordance with an image signal output from an original reading apparatus (not shown) connected to an apparatus main body 100A or a host apparatus such as a personal computer connected to the apparatus main body 100A so that communication is enabled therebetween. As the recording material, sheet materials such as a sheet, a plastic film, and cloth are given. Further, the image forming portions PY, PM, PC, and PK form toner images (images) of yellow, magenta, cyan, and black, respectively.

The four image forming portions PY, PM, PC, and PK included in the image forming apparatus 100 have substantially the same configuration except for the difference in developing color. Therefore, the image forming portion PY is described as a representative, and description of other image forming portions is omitted.

Figure 2A:
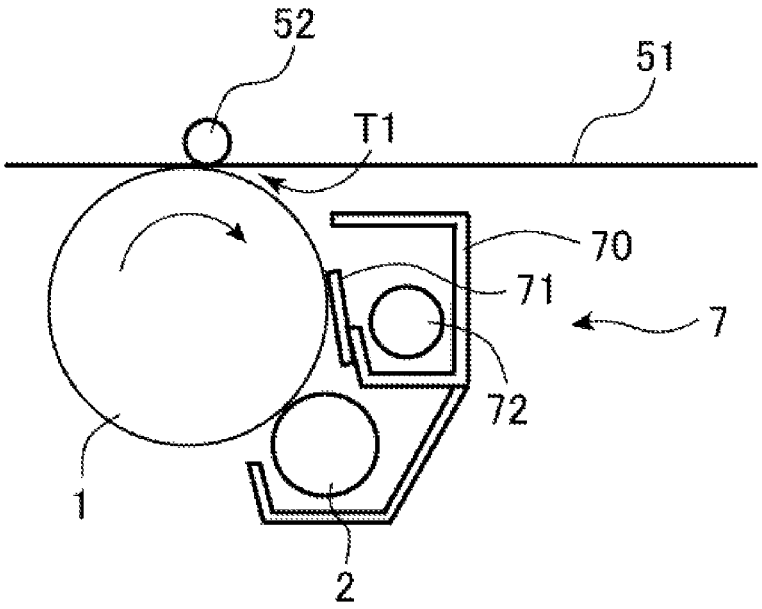
FIG. 2A is a view for illustrating a drum cleaning device.

As illustrated in FIG. 1 and FIG. 2A, the image forming portion PY includes a cylindrical photosensitive member, that is, the photosensitive drum 1 as the image bearing member. The photosensitive drum 1 is driven to rotate in a direction of the arrow in FIG. 2A. Around the photosensitive drum 1, there are arranged a charging roller 2, a developing device 4, a primary transfer roller 52, and a drum cleaning device 7. Below the photosensitive drum 1 in FIG. 1, an exposure device (laser scanner in this embodiment) 3 is arranged.

As illustrated in FIG. 1, a transfer device 5 is arranged above the image forming portions. The transfer device 5 is configured so that an endless intermediate transfer belt 51 is stretched by a plurality of rollers to be moved around (rotate) in the arrow direction. Further, as described later, the intermediate transfer belt 51 bears and conveys a toner image that has been primarily transferred onto the intermediate transfer belt 51. At a position opposed across the intermediate transfer belt 51 to a secondary transfer inner roller 53 among the rollers stretching the intermediate transfer belt 51, a secondary transfer outer roller 54 is arranged, and the secondary transfer outer roller 54 forms a secondary transfer portion T2 for transferring the toner image formed on the intermediate transfer belt 51 onto the recording material. In this embodiment, a process speed is 300 mm/s. On the downstream of the secondary transfer portion T2 in a recording material conveyance direction, a fixing device 6 is arranged.

In a lower portion of the image forming apparatus 100, a cassette 9 receiving recording materials S is arranged. The recording material S fed from the cassette 9 is conveyed by conveyance rollers 91 toward registration rollers 92. Then, a leading edge of the recording material S abuts against the registration rollers 92 in a stopped state so that the recording material S forms a loop. Thus, the skew feed of the recording material S is corrected. After that, the rotation of the registration rollers 92 is started in synchronization with the toner image formed on the intermediate transfer belt 51 so that the recording material S is conveyed to the secondary transfer portion T2.

A process of forming, for example, a full four-color image by the image forming apparatus 100 configured as described above is described. First, when an image forming operation is started, the surface of the rotating photosensitive drum 1 is uniformly charged by the charging roller 2. Next, the photosensitive drum 1 is exposed with laser light, which is emitted from the exposure device 3 and corresponds to an image signal. In this manner, an electrostatic latent image corresponding to the image signal is formed on the photosensitive drum 1. The electrostatic latent image on the photosensitive drum 1 is visualized by toner, which is stored in the developing device 4 and serves as developer, to become a visible image.

The toner image formed on the photosensitive drum 1 is primarily transferred onto the intermediate transfer belt 51 at a primary transfer portion T1 formed between the photosensitive drum 1 and the primary transfer roller 52, which is arranged across the intermediate transfer belt 51. At this time, a primary transfer bias is applied to the primary transfer roller 52. Toner (un-transferred residual toner) remaining on the surface of the photosensitive drum 1 after the primary transfer is removed by the drum cleaning device 7.

Such an operation is sequentially performed in the image forming portions for yellow, magenta, cyan, and black so that toner images of four colors are superimposed one after another on the intermediate transfer belt 51. After that, the recording material S received in the cassette 9 is conveyed to the secondary transfer portion T2 in synchronization with the timing to convey the toner image. Then, a secondary transfer bias is applied to the secondary transfer outer roller 54 so that the toner images of four colors on the intermediate transfer belt 51 are secondarily transferred in a collective manner onto the recording material S. Un-transferred residual toner remaining on the intermediate transfer belt 51 without being transferred at the secondary transfer portion T2 is removed by a belt cleaning device 8.

Then, the recording material S is conveyed to the fixing device 6. The fixing device 6 includes a fixing roller 61 and a pressure roller 62. The fixing roller 61 includes therein a heat source, for example, a halogen heater. The fixing roller 61 and the pressure roller 62 form a fixing nip portion. The recording material S having the toner image transferred thereon passes through the fixing nip portion of the fixing device 6 so that the recording material S is heated and pressurized. Then, the toner on the recording material S is melted and mixed so that the toner is fixed to the recording material S as a full-color image. After that, the recording material S is delivered to a delivery tray 102 by delivery rollers 101, and a series of image forming processes are ended.

The image forming apparatus 100 according to this embodiment is capable of forming a monochrome or multicolor image, such as a black monochrome image, with use of an image forming portion for a desired monochrome color or image forming portions for several colors among the four colors.

As illustrated in FIG. 2A, the drum cleaning device 7 includes a cleaning container 70, a cleaning blade 71 provided in the cleaning container 70 along a longitudinal direction, and a conveyance screw 72. The cleaning blade 71 is an elastic blade having an edge portion brought into abutment in a counter direction against the surface of the rotating photosensitive drum 1. With the cleaning blade 71, the surface of the photosensitive drum 1 is cleaned when the photosensitive drum 1 is rotated, and the primary un-transferred residual toner on the drum surface is scraped off into the cleaning container 70. The scraped toner is conveyed in the cleaning container 70 by the rotation of the conveyance screw 72 from a depth side to a front side in the longitudinal direction, and is introduced into a conveyance pipe 10 (see FIG. 1) for collected toner from a toner discharge port formed on the front side of the cleaning container 70.

Figure 2B:
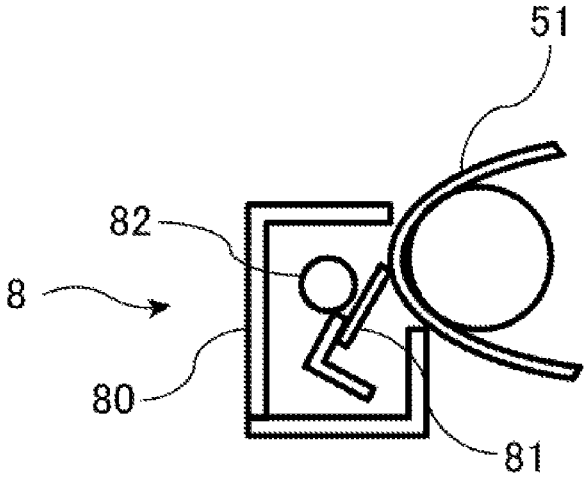
FIG. 2B is a view for illustrating a belt cleaning device.

As illustrated in FIG. 2B, the belt cleaning device 8 includes a cleaning container 80, a cleaning blade 81 provided in the cleaning container 80 along a longitudinal direction, and a conveyance screw 82. The cleaning blade 81 is an elastic blade having an edge portion brought into abutment in a counter direction against the surface of the rotating intermediate transfer belt 51. With the cleaning blade 81, the surface of the intermediate transfer belt 51 is cleaned when the intermediate transfer belt 51 is rotated, and the secondary un-transferred residual toner on the belt surface is scraped off into the cleaning container 80. The scraped toner is conveyed in the cleaning container 80 by the rotation of the conveyance screw 82 from a depth side to a front side in the longitudinal direction, and is introduced into the conveyance pipe 10 (see FIG. 1) for collected toner from a toner discharge port formed on the front side of the cleaning container 80.

As illustrated in FIG. 1, the collected toner discharged from each image forming portion and introduced into the conveyance pipe 10 is conveyed in the conveyance pipe 10 by the rotation of a conveyance screw arranged in the conveyance pipe 10 toward a container 11, and is stored in the container 11. That is, the container 11 stores toner collected from each of the image forming portions PY, PM, PC, and PK. The container 11 is removably mounted to a container mounting portion 103 of the apparatus main body 100A. When the containing amount of the stored toner reaches an allowable amount, the container 11 is removed from the apparatus main body 100A to be replaced with an empty container 11.

Figure 3:
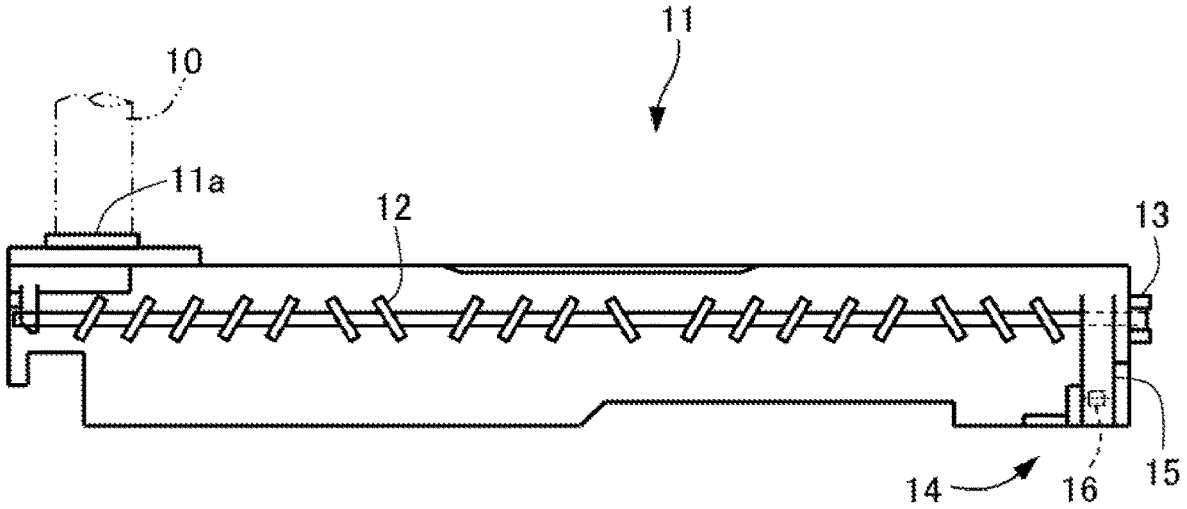
FIG. 3 is a sectional view for illustrating a container in the embodiment.

As illustrated in FIG. 3, the container 11 is a substantially cuboid container made of, for example, non-rigid plastic. The container 11 has an opening portion 11*a*, which is opened upward on one end side of an upper surface wall portion, as a collected toner inlet opposed to the conveyance pipe 10. In the opening portion 11*a*, for example, a shutter (not shown) is provided. The shutter is configured to open and close in association with an operation of mounting and removing the container 11.

The collected toner flowing in from the opening portion 11*a* is loaded into the container 11 while the powder surface is leveled by a conveyance screw (conveyance unit) 12, which is provided in the container 11 so as to be rotatable, and is configured to convey toner while stirring the toner. That is, the conveyance screw 12 conveys toner through rotation. In this embodiment, the conveyance screw 12 is made of, for example, plastic, and is supported about an axis so as to be rotatable and substantially horizontal between both end portions of the container 11 in the longitudinal direction. An end portion of the conveyance screw 12 on the opposite side of the opening portion 11*a* in the rotational axis protrudes outward from the container 11 and is supported, and a coupling 13 is provided at the protruding end portion.

The coupling 13 is coupled to be driven by a drive motor (conveyance unit) 20 (see FIG. 4) provided in the apparatus main body 100A via a drive system. The coupling 13 is driven to rotate by the drive motor 20 so that the conveyance screw 12 is driven to rotate. That is, the conveyance unit configured to convey toner in the container 11 includes the conveyance screw 12 and the drive motor 20. In this embodiment, the conveyance screw 12 is made of an ABS resin, and the coupling 13 employs a polyoxymethylene (POM) member having a high sliding property. The coupling 13 slides at a rotation shaft-supporting part of the conveyance screw 12 so that troubles such as shaft cutting are less liable to occur. Further, a sealing member is provided at the shaft-supporting part from an inner side of the container so that toner is less liable to enter the shaft-supporting part.

At an end portion of the container 11 on the opposite side of the opening portion 11*a* in the longitudinal direction, a containing amount detection portion (toner amount detection unit) 14 configured to detect an amount of toner inside of the container 11 is provided. The containing amount detection portion 14 comprises a tubular portion 15 and an optical sensor 16. The tubular portion 15 is a transparent vertically-long tubular portion and is provided in the container 11. The optical sensor 16 is provided in the apparatus main body 100A so as to be opposed to a lower portion of the tubular portion 15. The tubular portion 15 protrudes in a convex manner to the outer side of the container 11 and is opened only on the upper side. Thus, toner loaded into the container 11 enters the tubular portion 15 from the upper side to be deposited. The optical sensor 16 includes a light emitting portion and a light receiving portion. An optical path between the light emitting portion and the light receiving portion passes through the lower portion of the tubular portion 15. Under a state in which toner is not deposited to the height of the optical path of the tubular portion 15, light emitted from the light emitting portion passes through the lower portion of the tubular portion 15 to enter the light receiving portion. In this manner, it is detected that the toner containing amount has not reached a predetermined amount. Under a state in which toner is deposited to the height of the optical path of the tubular portion 15, light emitted from the light emitting portion is blocked by the toner so as to be prevented from entering the light receiving portion. In this manner, it is detected that the toner containing amount has reached the predetermined amount.

Figure 4:
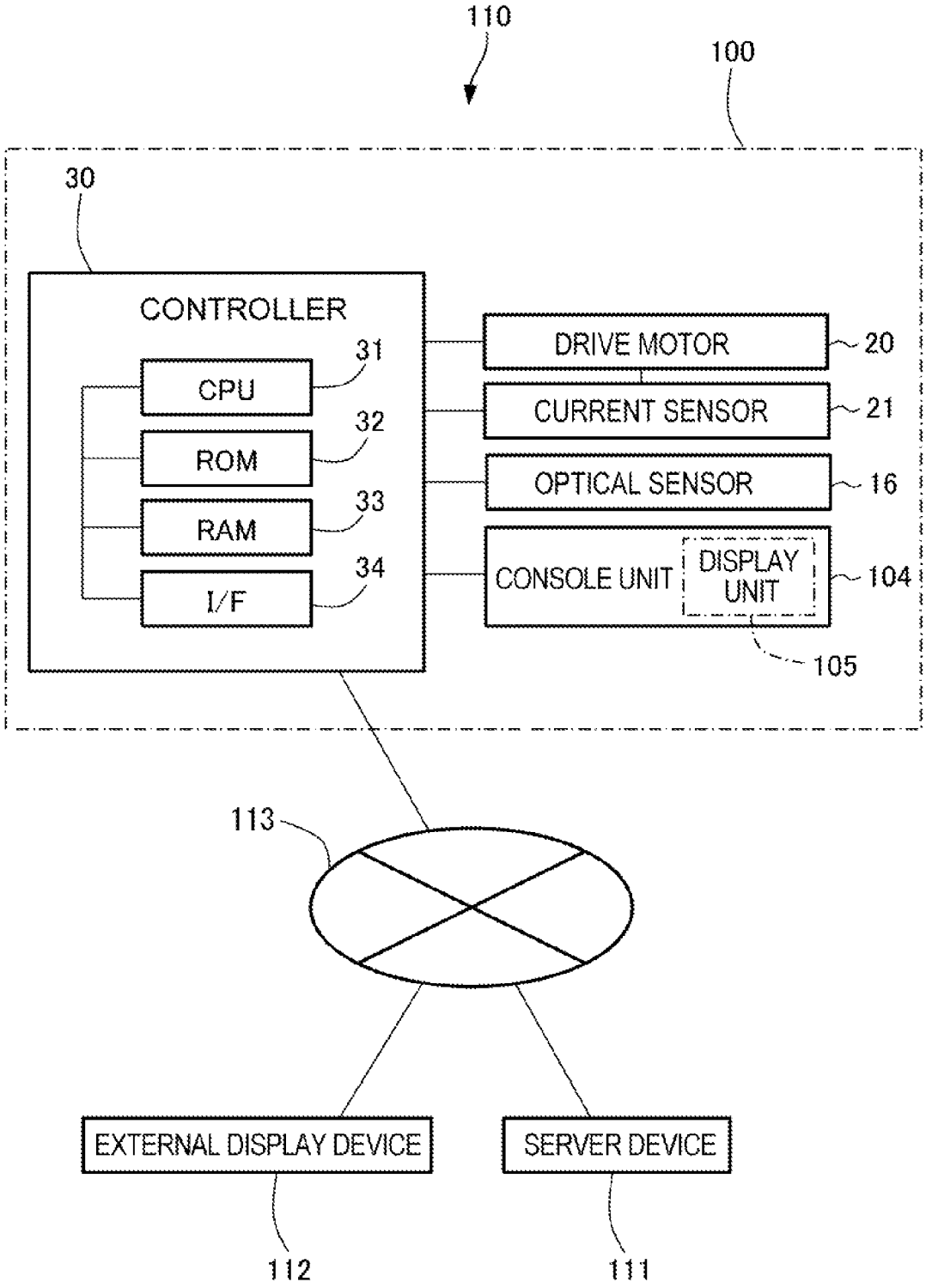
FIG. 4 is a control block diagram for illustrating the image forming apparatus according to the embodiment.

As illustrated in FIG. 4, a controller 30 is constructed of a computer, and includes, for example, a CPU 31, a ROM 32 configured to store a program for controlling each portion, a RAM 33 configured to temporarily store data, and an input/output circuit (I/F) 34 configured to input and output a signal to and from the outside. The CPU 31 is a microprocessor configured to manage the entire control of the image forming apparatus 100, and is a main device of a system controller. The CPU 31 is connected to a sheet feeding portion, the image forming portions PY, PM, PC, and PK, a sheet delivery portion, and a console unit 104 via the input/output circuit 34, and is configured to exchange signals with the portions and control the operation. In the ROM 32, for example, an image formation control sequence for forming an image on the recording material S is stored. The controller 30 is connected to the drive motor 20, a current sensor (load sensor) 21, and the optical sensor 16, and signals are transmitted and received between the controller 30 and each of the devices. The current sensor 21 detects a current to be supplied to the drive motor 20 so that the controller 30 can detect a magnitude of a load of rotation torque of the conveyance screw 12. The current sensor 21 detects that the magnitude of the load of the rotation torque of the conveyance screw 12 is an allowable load value or more (threshold value or more).

The console unit 104 includes a display unit 105 including operation buttons and a liquid crystal panel. A printing job can be executed when the user operates the console unit 104. The controller 30 receives a signal from the console unit 104 to operate various devices of the image forming apparatus 100. The display unit 105 can display various settings and states. Further, the display unit 105 receives a replacement preparation notification to be described later, which is output from the controller 30, to display a replacement preparation alarm, and receives a replacement notification to be described later to display a replacement alarm.

The image forming apparatus 100 configured as described above is incorporated in an image forming system 110. That is, the image forming system 110 includes the image forming apparatus 100, a server device 111, and an external display device 112. The image forming apparatus 100 is installed at a usage environment of the user, such as a market. The server device 111 is installed at, for example, a management department of a management company for the image forming system 110. The external display device 112 is installed at a usage environment of a serviceman, such as a sales company or a delivery center. The image forming apparatus 100, server device 111, and external display device 112 are connected to each other via a network 113.

In this case, depending on the situation of user's contract, for example, when delivery of the container 11 is included in the contract, the replacement preparation notification from the image forming apparatus 100 may be directly output to the server device 111 and the external display device 112 without being displayed on the display unit 105. In this case, the sales company that has received the replacement preparation notification can rapidly deliver the container 11 to the user. Alternatively, depending on the situation of the user's contract, for example, when delivery of the container 11 is not included in the contract, the replacement preparation notification from the image forming apparatus 100 is displayed on the display unit 105, and the user that has seen the replacement preparation notification orders the delivery of the container 11 by himself or herself. That is, the display unit 105 displays, of the replacement preparation notification and the replacement notification, at least the replacement notification.

Figure 5:
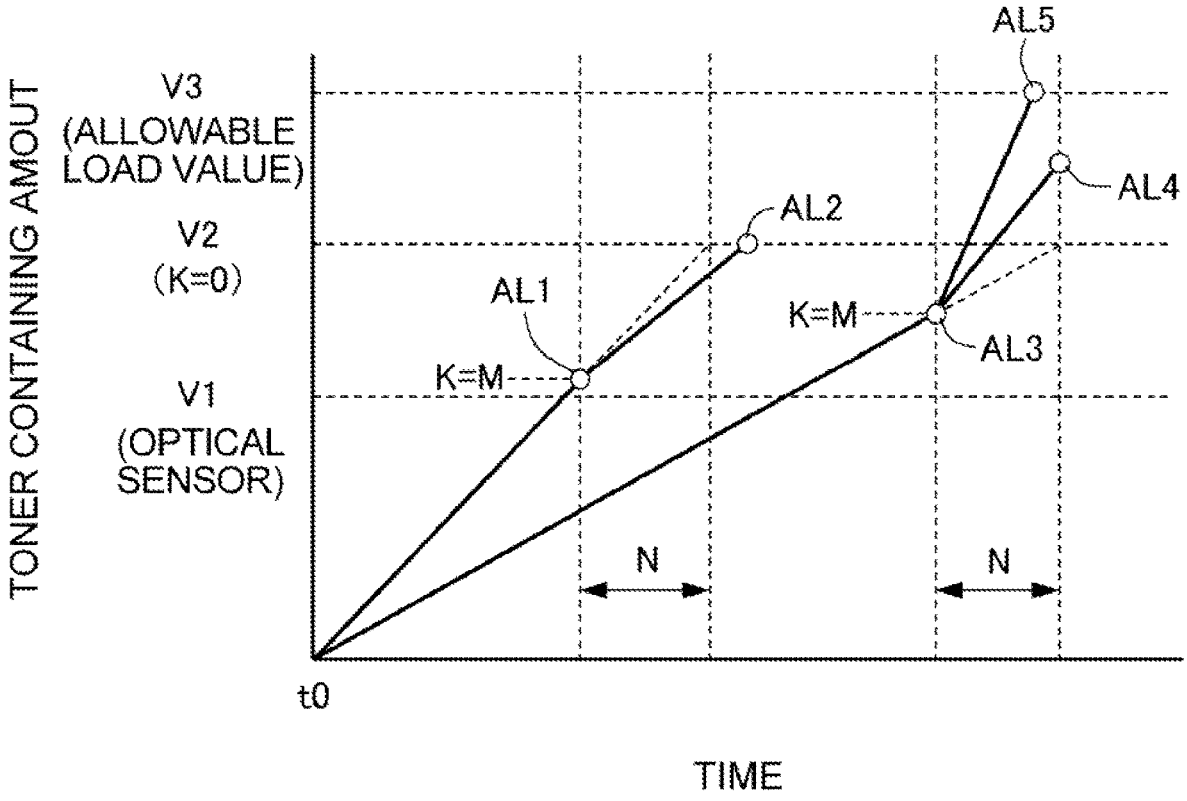
FIG. 5 is a time chart for illustrating a relationship between time and a toner containing amount in the image forming apparatus according to the embodiment.

In this embodiment, the controller 30 constructs a first output unit, a second output unit, and an execution unit. As illustrated in FIG. 5, the controller 30 serving as the first output unit outputs a replacement preparation notification (first notification) AL1 or AL3 and causes the display unit 105 to display the replacement preparation alarm based on a detection result of the containing amount detection portion 14. Further, the controller 30 serving as the first output unit outputs the replacement preparation notification (first notification) AL1 or AL3 and causes the display unit 105 to display the replacement preparation alarm based on a count value counted along with image formation from when the containing amount detection portion 14 detects that the amount of toner inside of the container 11 exceeds a predetermined amount. The replacement preparation notifications AL1 and AL3 are notifications for notifying the user that the container 11 is almost full (near end), that is, notifications for urging the user to prepare for the container 11 for replacement because the timing to replace the container 11 is close. Here, the notifications for urging the user to prepare for the container 11 for replacement may be, for example, a notification for urging the user or the serviceman to arrange delivery of the container 11. In this embodiment, the controller 30 outputs the replacement preparation notification AL1 or AL3 based on the fact that the containing amount detection portion 14 detects that the amount of toner inside of the container 11 exceeds the predetermined amount. The controller 30 has stored therein a preparation period (predetermined period) N set in advance. The preparation period N is set in consideration of a period required for the container 11 for replacement to be delivered from a shipping source of the container 11 to come to the user's hand. The preparation period N is preferred to be, for example, from about 5 days to about 7 days, and in this embodiment, the preparation period N is 5 days. The preparation period N is not necessarily required to match the period actually required for preparation, and includes a deviation of several days from the period actually required for preparation.

Further, the controller 30 serving as the second output unit starts measurement of a counter K that proceeds along with the image formation after the optical sensor 16 detects the near end (toner containing amount V1). That is, the controller 30 has the counter K that can be counted until the container 11 becomes full from when the optical path of the optical sensor 16 of the containing amount detection portion 14 is blocked. The counter K is a value determined based on a containing count value that is set based on data such as a print percentage, a toner replenishment amount, the number of times of image formation, and a video count. For example, when the counter K is a containing count value set based on the print percentage, the controller 30 includes a print percentage acquisition portion configured to acquire the print percentage of the image, and the counter K is counted based on an accumulation value of the print percentage of the image, which is acquired by the print percentage acquisition portion. When the counter K is a containing count value set based on the toner replenishment amount, the controller 30 includes a replenishment amount acquisition portion configured to acquire a replenishment amount of toner to be replenished to the developing device 4, and the counter K is counted based on an accumulation value of the toner replenishment amount acquired by the replenishment amount acquisition portion. When the counter K is a containing count value set based on the number of times of image formation, the controller 30 includes an image formation number acquisition portion configured to acquire the number of times of image formation, and the counter K is counted based on an accumulation value of the number of times of image formation acquired by the image formation number acquisition portion. When the counter K is a containing count value set based on the video count, the controller 30 includes a video count acquisition portion configured to acquire the video count value, and the counter K is counted based on an accumulation value of the video count value acquired by the video count acquisition portion.

The counter K is subtracted in accordance with the containing count value from an available amount M set in advance, and the controller 30 determines that the container 11 is full when a target value of 0 is obtained (toner containing amount V2). The full-state determination by the counter K includes a margin including variation factors, and hence is made earlier than the full-state determination made based on the magnitude of the rotation torque of the conveyance screw 12. Further, in this embodiment, the counter K is set after the detection (at the time of detection) by the containing amount detection portion 14. The discharge amount of collected toner varies depending on the temperature and the humidity of the surrounding environment, the type of the recording material to be subjected to printing, and the states of components, and hence the accuracy of the loaded amount at the time of the full state can be enhanced as compared to that when the counter K is set to a fixed value in advance from the beginning of usage.

Then, the controller 30 serving as the second output unit outputs, after outputting the replacement preparation notification AL1 or AL3, a replacement notification (second notification) AL2 or AL4 and causes the display unit 105 to display the replacement alarm at a predetermined timing to be described later. The replacement notifications AL2 and AL4 are notifications for notifying the user that the container 11 is full, that is, notifications for urging the user to replace the container 11 because the container 11 is full. In this embodiment, the image formation is stopped along with the output of the replacement notification AL2 or AL4, and the image formation is inhibited until the container 11 is replaced.

Next, the timing to display various alarms when the toner containing amount is increased in the container 11 of the image forming apparatus 100 according to this embodiment is described with reference to the time chart of FIG. 5. After a new container 11 is mounted (t0), the toner containing amount is increased. It is assumed here that, when the toner containing amount is V1 or more, the optical path of the optical sensor 16 is blocked and it is detected that the toner containing amount is V1 or more.

The controller 30 stores a value corresponding to a daily toner containing amount of the container 11 based on the user's usage situation, and activates a timer to store a usage period from t0. The controller 30 calculates, at a time point of detection by the optical sensor 16, an available period L, which is a period until the remaining toner amount (counter K) that can be stored in the container 11 becomes 0, based on the usage period and the accumulation value of the value corresponding to the amount toner stored in the container 11. For example, when the available period L is 7 days and the preparation period N is 5 days, after 2 days from the detection by the optical sensor 16, the replacement preparation notification AL1 or AL3 is output and the replacement preparation alarm is displayed on the display unit 105. That is, the preparation period N refers to a predetermined period from when the replacement preparation notification AL1 or AL3 is output (from when the replacement preparation alarm is displayed). That is, it is estimated that the container 11 becomes full after the preparation period N elapses from when the replacement preparation alarm is displayed (indicated by the broken line in FIG. 5), and the container 11 can be used without waste in this case. After the replacement preparation notification AL1 or AL3 is output, the controller 30 subtracts the counter K from the available amount M in accordance with the usage situation, and in principle, outputs the replacement notification and stops the image formation at a time point at which the counter K becomes 0. In other words, at a time point at which the counter K obtained by subtracting the counted containing count value from the available amount M becomes 0 from when the optical sensor 16 detects the near end (toner containing amount V1), the replacement notification is output and the image formation is stopped.

In some cases, after the replacement preparation notification AL1 or AL3 is output, a usage situation may vary from an estimated situation, and the containing amount of toner stored in a certain period may be changed from the estimated containing amount. For example, when the toner containing amount is smaller than estimated after the replacement preparation notification AL1 is output, the counter K does not reach the target value of 0 even after the preparation period N elapses. Therefore, the container 11 can still store toner in a normal range, and hence the replacement notification is not output even when the preparation period N elapses. The replacement notification AL2 is output at the time when the counter K becomes the target value of 0 or after the time when the counter K becomes the target value of 0 (toner containing amount V2). That is, the controller 30 serving as the second output unit outputs, after outputting the replacement preparation notification AL1, the replacement notification AL2 and causes the display unit 105 to display the replacement alarm at the time or after the time when the counter K reaches the target value of 0 at the time or after the time when the preparation period N elapses. In other words, when the counter K does not reach the target value of 0 during the preparation period N from when the replacement preparation notification AL1 is output, the controller 30 serving as the second output unit outputs the replacement notification AL2 and causes the display unit 105 to display the replacement alarm based on the counter K.

Meanwhile, for example, when the toner containing amount is larger than estimated after the replacement preparation notification AL3 is output, the counter K becomes the target value of 0 before the preparation period N elapses. In this case, when the replacement notification is output and the image formation is stopped in response to the counter K reaching the target value of 0, a long time period may be required for replacement from when the image formation is stopped. In view of this, after the replacement preparation notification AL3 is output, when the counter K reaches the target value of 0 before the preparation period N elapses, the controller 30 serving as the second output unit does not output the replacement notification at the time point. Then, the controller 30 outputs the replacement notification AL4 at the time when the preparation period N elapses after the counter K reaches the target value of 0 or after the time when the preparation period N elapses (at the time or after the time when the preparation period N elapses). In other words, when the counter K reaches the target value of 0 during the preparation period N from when the replacement preparation notification AL3 is output, the controller 30 serving as the second output unit outputs the replacement notification AL4 and causes the display unit 105 to display the replacement alarm based on an elapsed time from when the replacement preparation notification AL3 is output. In this manner, even when the number of times of image formation abruptly increases more than estimated after the replacement preparation notification is output, the image forming apparatus 100 can be prevented from being unusable for a long period.

In this case, the available amount M, which is the value of the counter K when the replacement preparation notification AL1 or AL3 is output, is a value having a margin with respect to the loadable toner containing amount, and is set so as not to reach the allowable load value before the counter K becomes the target value of 0. This setting is made to prevent stoppage of image formation in the middle of the preparation period N from the replacement preparation notification, which is estimated by the controller 30. In this embodiment, when the counter K reaches or falls below the target value of 0, at the timing at which the preparation period N is reached or after the preparation period N is reached (at the time or after the time when the preparation period N elapses), the replacement notification AL4 is output. Further, the detection level of the optical sensor 16 is set in advance so that the allowable load value is not reached at those timings. That is, the predetermined amount detected by the containing amount detection portion 14 is set so that the replacement notification AL4 is output before the current sensor 21 detects that the magnitude of the load of the conveyance screw 12 is the allowable load value or more. When the allowable load value is reached, a replacement notification AL5 is output, and the image formation is inhibited (toner containing amount V3).

Further, the controller 30 serving as the execution unit starts measurement of the counter K that proceeds along with the image formation from when the replacement preparation notification AL1 or AL3 is output, and is capable of executing a first mode of outputting the replacement notification AL2 and a second mode of outputting the replacement notification AL4.

Figure 6:
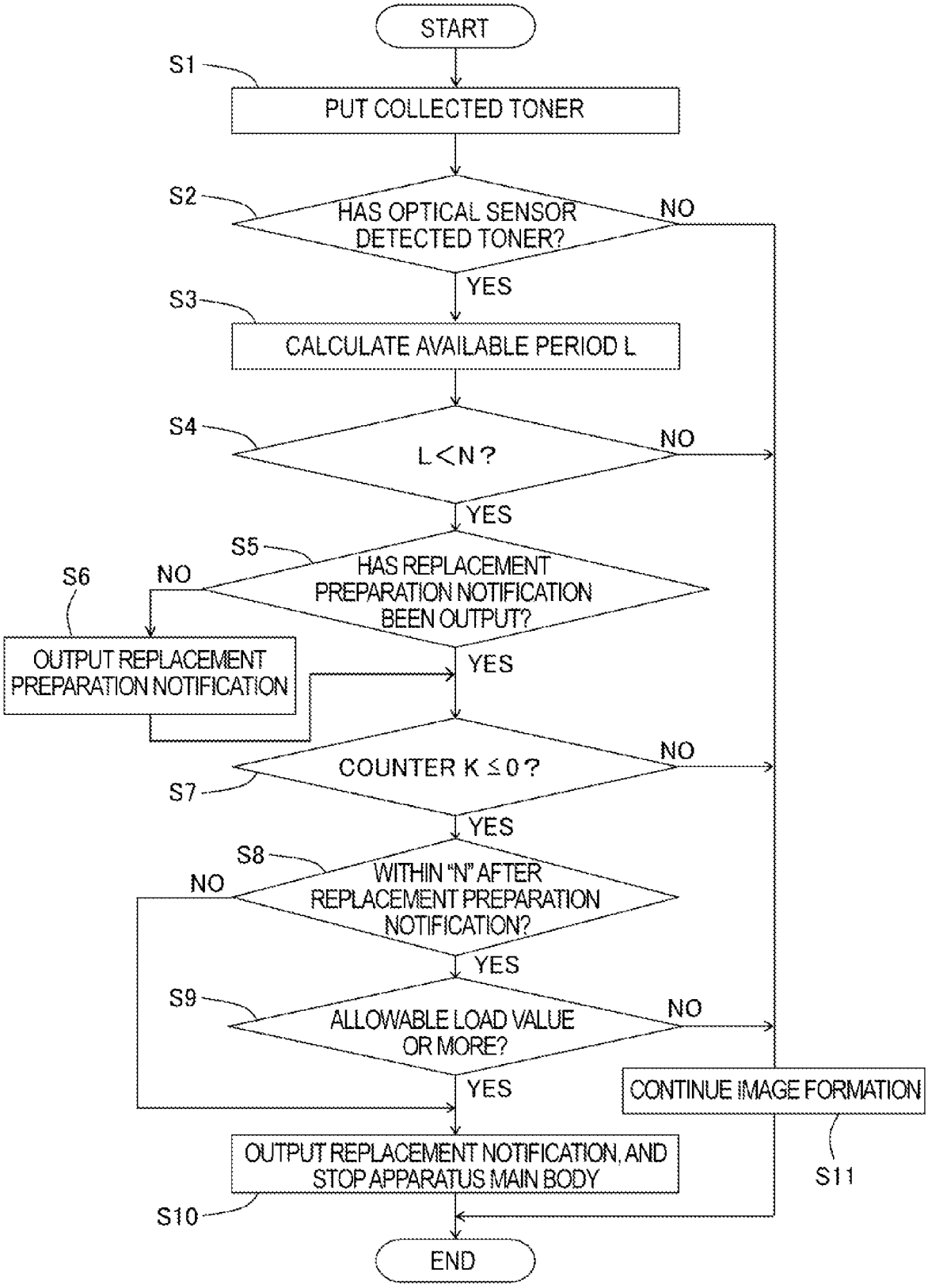
FIG. 6 is a flow chart for illustrating a processing procedure of toner collection in the image forming apparatus according to the embodiment until a replacement notification is output.

Next, a processing procedure performed when the toner containing amount is increased in the container 11 of the image forming apparatus 100 according to this embodiment is described with reference to the flow chart of FIG. 6. The controller 30 starts the timer from when a new container 11 is mounted. Image formation is executed by the image forming apparatus 100, and the collected toner is loaded into the container 11 (Step S1). The controller 30 determines whether or not the optical sensor 16 of the containing amount detection portion 14 has detected the deposition of toner (Step S2). When the controller 30 determines that the optical sensor 16 has detected the deposition of toner, the controller 30 calculates the available period L until the container 11 becomes full based on the value of (V2−V1) and the value of the timer (Step S3).

Further, the controller 30 determines whether or not the available period L is shorter than the preparation period N (Step S4). When the controller 30 determines that the available period L is shorter than the preparation period N, the controller 30 determines whether or not the replacement preparation notification has been output (Step S5). When the controller 30 determines that the replacement preparation notification has not been output, the controller 30 outputs the replacement preparation notification (Step S6). After the replacement preparation notification is output or when the controller 30 determines that the replacement preparation notification has been output in Step S5, the controller 30 determines whether or not the counter K is 0 or less (Step S7). When the controller 30 determines that the counter K is 0 or less, the controller 30 determines whether or not the current time is within the preparation period N after the replacement preparation notification is output (Step S8). When the controller 30 determines that the current time is within the preparation period N after the replacement preparation notification is output, the controller 30 determines whether or not the detection value of the current sensor 21 is the allowable load value or more (Step S9).

When the controller 30 determines that the detection value of the current sensor 21 is the allowable load value or more, the controller 30 outputs the replacement notification, and stops the operation of the apparatus main body 100A (Step S10). Further, when the controller 30 determines that the current time is not within the preparation period N after the replacement preparation notification is output in Step S8, the controller 30 outputs the replacement notification, and stops the operation of the apparatus main body 100A (Step S10). Further, when the controller 30 determines that the optical sensor 16 has not detected the deposition of toner in Step S2 or when the controller 30 determines that the available period L is not shorter than the preparation period N in Step S4, the controller 30 continues the image formation (Step S11). Further, also when the controller 30 determines that the counter K is not 0 or less in Step S7 or when the controller 30 determines that the detection value of the current sensor 21 is not the allowable load value or more in Step S9, the controller 30 continues the image formation (Step S11). In this case, the controller 30 subtracts the counter K in accordance with data such as the print percentage or the toner replenishment amount.

As described above, according to the image forming apparatus 100 of this embodiment, the controller 30 does not output the replacement notification even when the counter K reaches the target value of 0 in a case in which the counter K reaches the target value of 0 before the preparation period N elapses after the replacement preparation notification AL3 is output. Then, the controller 30 outputs the replacement notification AL4 at the time or after the time when the preparation period N elapses thereafter. Therefore, even when the number of times of image formation of the user abruptly increases more than estimated after the output of the replacement preparation notification AL3, which is output when the toner containing amount of the container 11 is close to the allowable amount, the image forming apparatus 100 can be prevented from being unusable for a long period. As in this embodiment, in a case in which the image formation is continued when the counter K reaches the target value of 0, the toner powder surface height is liable to exceed the height of the conveyance screw 12 so that the toner powder is deposited. The toner deposited above the height of the conveyance screw 12 cannot be easily conveyed by the conveyance screw 12, and toner may be aggregated when toner is left as it is for a long period. In this case, there is a risk that toner clogging occurs upstream of the conveyance screw 12 before the rotation load of the conveyance screw 12 is increased. However, the above-mentioned risk is not required to be concerned when, as in this embodiment, a period from when the counter K reaches the target value to when the preparation period N elapses is short.

As described above, in the embodiment, the controller 30 controls the replacement notification and the inhibition of the image forming operation based on the counter K and the detection result of the current sensor 21 as a load sensor. Furthermore, according to the embodiment, the controller 30 uses different triggers for performing the replacement notification depending on a toner consumption amount. That is, a case where an operation of forming images on a predetermined number of sheets per day, in which a toner consumption amount of an image per sheet is a first predetermined amount, is repeated will be considered. In this case, since the toner consumption amount per day is small, the counter K does not become zero during the preparation period N. Therefore, when the counter K becomes zero, the controller 30 outputs the replacement notification (AL2, AL4 in FIG. 5) to inhibit the image formation. On the other hand, a case where an operation of forming images on the predetermined number of sheets per day, in which a toner consumption amount of an image per sheet is a second predetermined amount larger than the first predetermined amount, is repeated will be considered. In this case, the toner consumption amount per day is large. Therefore, the counter K becomes zero during the preparation period N. In this case, the controller 30 permits the continuation of the image formation even when the counter K becomes zero, and during the preparation period N, the controller 30 outputs the replacement notification (AL5 in FIG. 5) based on the detection result of the current sensor 21 to inhibit the image formation.

Other Embodiment

In the above-mentioned embodiment, description is given of the case in which the configuration in which the tubular portion 15 blocks the optical path is employed as the containing amount detection portion 14, but the present invention is not limited thereto, and a detection unit using weight may be employed. In this embodiment, description is given of the case in which the counter K is set after the detection of the containing amount detection portion 14, but the present invention is not limited thereto. For example, the counter K may be set and the counting may be started from the beginning of the mounting of the container 11.

According to the present invention, even when the number of times of image formation of the user abruptly increases more than estimated after the output of the replacement preparation notification, which is output when the toner containing amount of the container is close to the allowable amount, the image forming apparatus can be prevented from being unusable for a long period.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2017-250194, filed Dec. 26, 2017, which is hereby incorporated by reference herein in its entirety.

What is claimed is:

1. An image forming apparatus, comprising:

an image forming portion configured to form an image;

a container configured to contain toner collected from the image forming portion;

a conveyance member, which is provided inside of the container so as to be rotatable, and is configured to convey the toner contained in the inside of the container;

a toner sensor configured to detect toner presence or toner absence at a detection portion provided in the inside of the container and downstream of the conveyance member with respect to a conveyance direction;

a count portion configured to count a value correlated to a toner amount collected into the container from a point in time when the toner sensor detects the toner presence;

a load sensor configured to detect a rotation load of the conveyance member; and a controller configured to inhibit image formation in a case that a detection result of the load sensor is a predetermined load value or more, wherein in a case that an elapsed time from the point in time when the toner sensor detects the toner presence until the value counted by the count portion reaches a predetermined count value is longer than a predetermined period, the controller inhibits image formation based on the value counted by the count portion, and wherein in a case that the elapsed time is shorter than the predetermined period, the controller is configured to allow an image forming operation to continue until the predetermined period elapses from the point in time when the toner sensor detects the toner presence.

2. The image forming apparatus according to claim 1, wherein in a case that the elapsed time is shorter than the predetermined period and the detection result of the load sensor does not reach the predetermined load value during the predetermined period, the controller inhibits the image formation at a time when the predetermined period elapses from the point in time when the toner sensor detects the toner presence.

3. The image forming apparatus according to claim 1, further comprising a drive motor configured to rotate the conveyance member, wherein the conveyance member includes a conveyance screw configured to rotate to convey the toner, and wherein the load sensor is configured to detect a current to be supplied to the drive motor.

4. The image forming apparatus according to claim 1, wherein the controller is configured to output preparation information for urging a replacement preparation of the container based on a detection result of the toner sensor.

5. The image forming apparatus according to claim 1, wherein the controller is configured to output replacement information for urging a replacement of the container based on the value counted by the count portion or the elapsed time.

6. The image forming apparatus according to claim 5, wherein in the case that the elapsed time is longer than the predetermined period, the controller outputs the replacement information based on the value counted by the count portion, and in the case that the elapsed time is shorter than the predetermined period, the controller outputs the replacement information based on the elapsed time.

* * * * *